US005813144A

United States Patent [19]

Prengler

[11] Patent Number: 5,813,144

[45] **Date of Patent: *Sep. 29, 1998**

[54] HINGED ENTRY FOOTWEAR WITH INFLATABLE BRACE

[76] Inventor: Randall Prengler, 4025 Desert Mountain Dr., Plano, Tex. 75093-7337

[ * ] Notice: The term of this patent shall not extend beyond the expiration date of Pat. No. 5,557,866.

[21] Appl. No.: 701,172

[22] Filed: Aug. 21, 1996

[51] Int. Cl.[6] ..... A43B 7/14; A43B 19/00

[52] U.S. Cl. ..... 36/88; 36/93; 36/71; 36/50.1; 36/138

[58] Field of Search ..... 36/88, 93, 99, 36/117.6, 71, 28, 29, 138, 114, 50.1

[56] References Cited

U.S. PATENT DOCUMENTS

| | | | |
|---|---|---|---|
| 6,333 | 3/1849 | Ballard | 36/50.1 |
| 145,801 | 12/1873 | Hersome | 36/50.1 |
| 474,574 | 5/1892 | Bruzon | 36/138 |
| 503,588 | 8/1893 | Elterich . | |
| 4,280,286 | 7/1981 | Sartor | 36/118 |
| 4,470,205 | 9/1984 | Olivieri | 36/114 |
| 4,633,599 | 1/1987 | Morell et al. | 36/50 |
| 4,813,668 | 3/1989 | Solloway | 272/116 |
| 4,823,484 | 4/1989 | Couty | 36/117 |
| 4,893,419 | 1/1990 | Arieh et al. | 36/119 |
| 4,972,613 | 11/1990 | Loveder | 36/105 |
| 4,999,932 | 3/1991 | Grim | 36/88 |
| 5,113,599 | 5/1992 | Cohen et al. | 36/88 |
| 5,184,410 | 2/1993 | Hamilton | 36/105 |
| 5,253,435 | 10/1993 | Auger et al. | 36/88 |
| 5,451,201 | 9/1995 | Prengler | 602/26 |
| 5,557,866 | 9/1996 | Prengler | 361/138 |

*Primary Examiner*—Paul T. Sewell
*Assistant Examiner*—Anthony Stashick
*Attorney, Agent, or Firm*—Akin, Gump, Strauss, Hauer & Feld, L.L.P.

[57] ABSTRACT

A hinged entry footwear for athletic and strenuous physical activity, includes a sole and heel structure, a forward foot casing secured to and above the sole, hinged anterior and posterior support casings extending vertically above the heel and an inflatable brace secured on the footwear including a main bladder portion for supporting the foot directly above the sole and heel and vertical stays disposed between the anterior and posterior casings and the wearer's ankle and lower leg. The central bladder includes an inflatable chamber disposed generally under the foot and the stays each include elongated upwardly extending inflatable chambers. A lateral branch of one of the stays extends across the front of the lower leg between the upper edge of the anterior casing and the lower leg. A manual inflation pump is secured to the lateral branch portion of the one stay and is supported by the anterior casing for inflating the brace to a selected working pressure. The casings and brace are secured to the foot, ankle and lower leg by straps which include quick release fasteners, such as hook and loop fastener strips.

21 Claims, 3 Drawing Sheets

HINGED ENTRY FOOTWEAR WITH INFLATABLE BRACE

FIELD OF THE INVENTION

The present invention pertain to athletic footwear characterized by a lower toe casing supported by a sole/heel structure, upward extending anterior and posterior casing portions hinged to the lower casing to provide entry and exit of the foot and an inflatable brace and cushioning structure engageable with the bottom of the foot and the ankle when the footwear is in its working position on a wearer's foot.

BACKGROUND

The substantial stress placed on the foot and ankle when performing in athletic endeavors, such as basketball, baseball, football, soccer and other activities which require extreme and rapid movement in many directions, has pressed the need for further improvements in athletic footwear, in particular. One significant improvement is disclosed in my U.S. Pat. No. 5,557,866 issued Sep. 24, 1996, wherein athletic footwear comprising a toe casing supported by a sole and heel structure supports upper, flexible frustoconical shaped anterior and posterior casing members which are hinged to the toe casing to provide for easy entry and exit of the foot with respect to the footwear while also providing improved support for the foot, ankle and lower leg of the wearer.

However, further improvements have been sought with respect to additional support and cushioning structure incorporated into the footwear formed either as a removable insert or as an integral part of the footwear. In this regard, it has been discovered that a unique modification to joint support apparatus, such as disclosed and claimed in my U.S. Pat. No, 5,451,201, provides yet further advantages in combination with hinged entry footwear.

A growing demand for athletic footwear that is comfortable to wear, provides substantial support to the foot and ankle without loosing flexibility of movement, particularly under the severe stresses imposed on the foot, ankle and lower leg in various athletic and other physical endeavors, and the desire to provide footwear meeting the abovementioned criteria while being easy to place on and remove from the foot has also pressed the need for further developments in footwear which meet these desiderata. It is to these ends that the present invention has been developed.

SUMMARY OF THE INVENTION

The present invention provides improved footwear, particularly of a type used for athletic activities and other activities placing significant stresses and deflection on and by a person's feet and ankles.

In accordance, with one aspect of the present invention a hinged entry athletic or outdoor activity style footwear is provided having a sole and heel structure, a toe and heel lower casing supported thereon flexible hinged anterior and posterior upwardly extending casings which are hinged to the lower casing structure to provide for easy entry and exit of the foot and inflatable brace means on the footwear which together with the upwardly extending casings, provide substantial support for the ankle and lower leg.

In particular, the improved footwear utilizes an inflatable brace disposed within the footwear and including a foot supporting pad portion and upwardly extending spaced apart inflatable stays which support the ankle and lower leg at multiple points therearound.

The invention still further provides improved footwear wherein an inflatable brace is insertable in and supported by a shoe or boot having a toe and heel or lower casing and upwardly extending hinged support casings wherein inflatable chambers of the brace are inflated and deflated by a pump and control valve arrangement which is advantageously mounted on the footwear in a position which does not interfere with use of the footwear or the comfort of the person wearing the footwear.

In accordance with still further aspects of the present invention, hinged entry footwear is provided with an inflatable brace and support structure for supporting the foot and ankle when the footwear is secured to the foot but which is arranged in such a way as to not impair placing the footwear on or removing the footwear from the wearer's foot. In this regard, the inflatable brace is configured to allow movement of hinged upper casing members between a foot and ankle supporting position and a position to provide ease of entry and exit of the foot from the footwear. Still further, the invention contemplates the provision of footwear, particularly adapted for strenuous, athletic or other physical activities which has superior foot supporting structure, is formed of substantially flexible materials to provide for flexing of the foot and ankle during use while also providing superior support and comfort, and which is easy to place on and secure to the foot or remove from the foot, when desired.

Those skilled in the art will further appreciate the abovementioned features and advantages of the invention together with other superior aspects thereof upon reading the detailed description which follows in conjunction with the drawing.

DESCRIPTION OF THE PREFERRED EMBODIMENT

Figure 1:
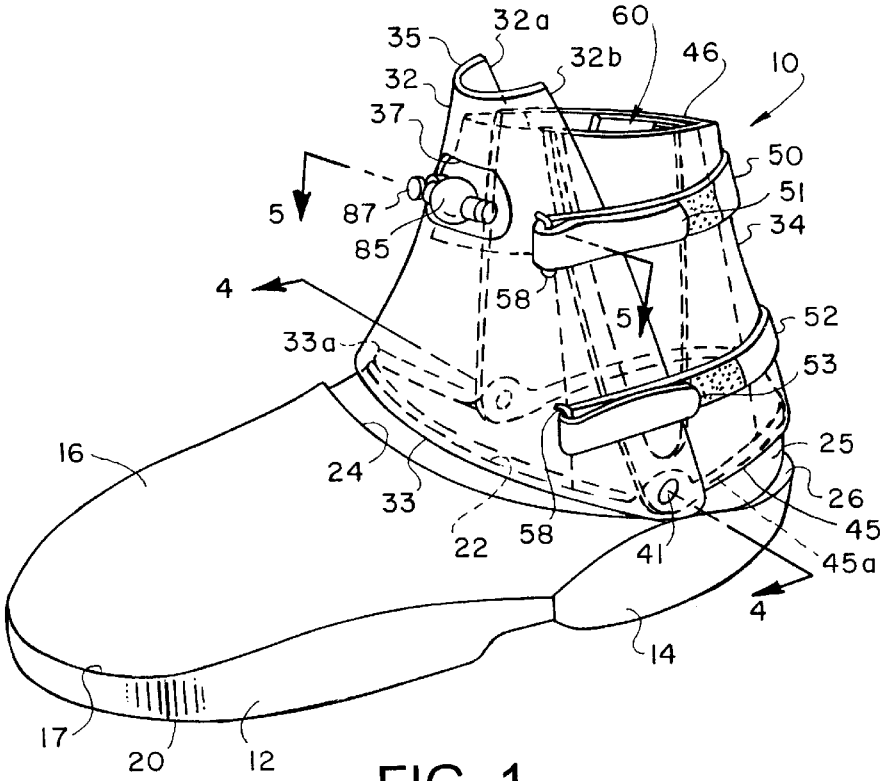
FIG. 1 is a perspective view of the improved footwear of the present invention in the closed position of the upper casings.

In the description which follows like parts are marked throughout the specification and drawing with the same reference numerals, respectively. The drawing figures are not necessarily to scale and certain elements may be shown in somewhat generalized form in the interest of clarity and conciseness.

Referring to FIG. 1, footwear in accordance with the present invention is illustrated and generally designated by the numeral 10. Footwear 10 is illustrated as one shoe of a pair of shoes, for example, the right shoe is shown and the left shoe would be a mirror image of the footwear shown. The footwear 10 is characterized as an athletic shoe having a substructure comprising a sole member 12, a heel member 14, and a forward lower casing or toe cap 16. The sole 12 and heel 14 may be formed as an integral molded structure covering the bottom side of a base member comprising a combination inner sole and heel member 18, see FIG. 4, and suitably bonded thereto.

The sole member 12, heel member 14, and inner sole and heel base member 18 may be formed out of suitable materials used in the production of athletic shoes such as molded polymers which may be manufactured as open or closed cell foam like structures to provide suitable cushioning for the wearer of the footwear 10. Still further, the bottom surface 20 of the sole 12 and heel 14 may be provided with suitable tread-like structure, not shown, to facilitate traction for the wearer, or adapted to support cleats or spikes for athletic activity on natural turf or clay-like surfaces, for example. The forward toe cap or casing 16 may be also be formed of a suitable polymer or other flexible material, such as leather or woven fabric, and secured around its peripheral edge 17 to the sole and heel members 12 and 14.

As described in my above referenced patent application, the forward toe casing 16 is formed integral with or joined to a somewhat rigid rearwardly extending peripheral lower casing portion 22 which is provided with an inset curb or ledge 24 extending from one lateral side of footwear 10 to the other. Casing portion 22 is joined to or integral with a similar rearward disposed casing portion 25 delimited by a peripheral inset portion or curb 26. Suitable upstanding boss portions 28 and 30 may be formed on the opposite sides of the casing portion 22, 25, see FIG. 4, for supporting hinge members which are connected to a generally frustoconical forward or anterior upper casing 32 and a rearward or posterior upper casing 34.

The anterior upper casing 32 is preferably formed of a flexible material, such as leather or heavy canvas or of moldable or fabricated, flexible polymer materials but also provides for support of the forward portion of the foot and ankle. The casing 32 is somewhat frustoconical in shape and is delimited by a lower curved edge 33 and an upper curved edge 35 having a shorter circumference than the edge 33. Lower curved edge 33 includes, preferably, a somewhat rigid reinforcing member 33*a* extending therealong and imbedded in or secured to the material forming casing 32. Opposed longitudinal edges 32*a* and 32*b* also delimit the upper anterior casing member 32. An elongated, somewhat oval opening 37 is formed in a forward facing portion of casing 32 for a purpose to be described further herein. Opposite lower corners of the casing 32 are provided with suitable bores or slots 39 and 40, see FIG. 4 also, for hingedly connecting the upper casing 32 to the casing portion 22, 25, on opposite sides thereof, as indicated. Hinge members 41 extend through suitable bores in the bosses 28 and 30 and the aforementioned bores in the upper casing 32 for securing the casing for pivotal and/or forward and rearward sliding movement about these hinge members. The hinge members 41 may be metallic or nonmetallic rivet elements, or threaded screw and nut combinations.

Figure 2:
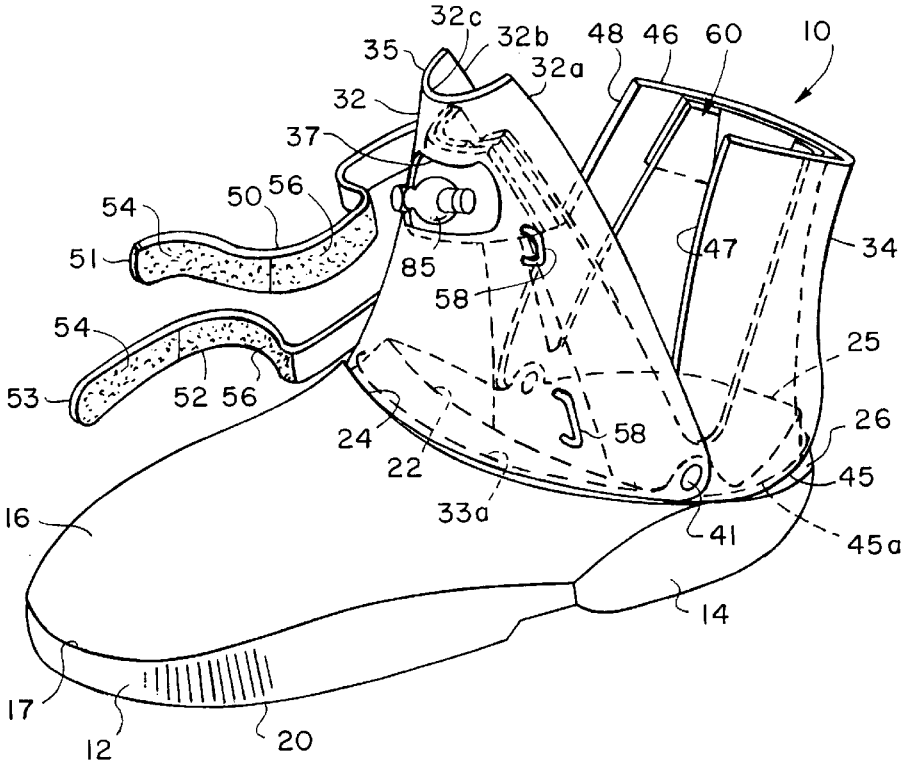
FIG. 2 is a perspective view of the footwear shown in FIG. 1 with the hinged upper casings in the open position to provide entry or exit of a foot with respect to the footwear.
Figure 4:
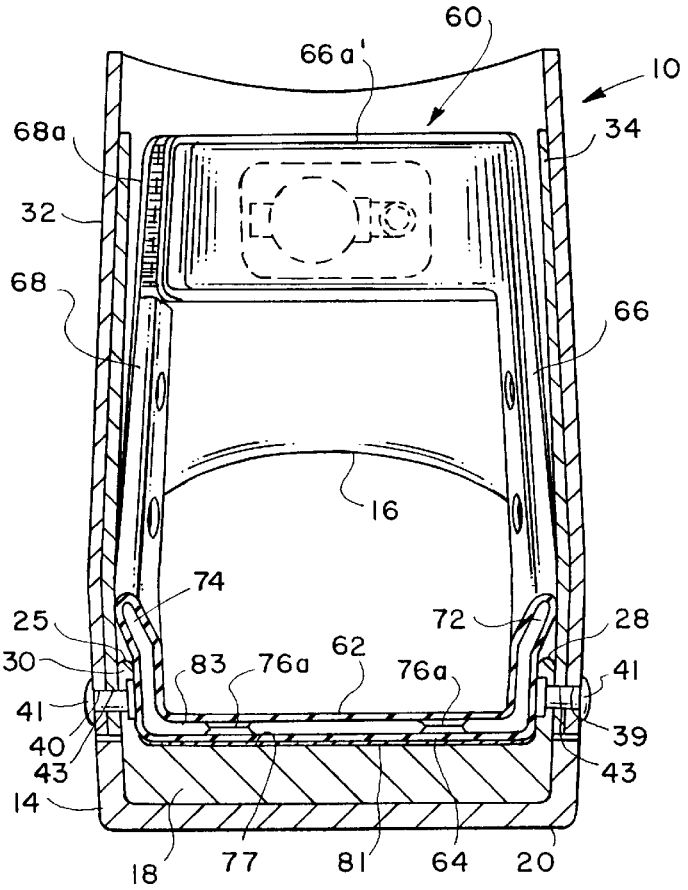
FIG. 4 is a section view taken generally along the line 4—4 of FIG. 1.

The posterior casing member 34 is also hingedly connected to the hinge members 41 at respective bores 43, see FIG. 4, formed on opposite portions of the casing member 34. Casing member 34 is further characterized by a generally arcuate, bottom edge 45 and a second arcuate top edge 46, providing the casing member as a somewhat frustoconical shaped member wherein the circumference of the edge 46 is less than the edge 45. The casing member 34 is also preferably formed of a somewhat flexible leather, woven fabric or other suitable material as described herein. An elongated, somewhat rigid reinforcing member 45*a* extends along edge 45 and is imbedded in or secured to the material forming casing 34. The casing member 34 is operable to pivot between the closed and open positions of the footwear 10, as shown in FIGS. 1 and 2, respectively, and opposed longitudinal side edges 47 and 48 of the casing member 34 are adapted to nest inside the casing member 32 when the footwear is in the closed working position shown in FIG. 1. Pivotal movement of the casing member 34 to the open position is limited by the edge or curb 26 engaging the lower edge 45 of the casing member 34.

The footwear 10 is maintained in a closed position by flexible closures comprising straps 50 and 52 which are suitably secured to one side of the anterior casing 32, as shown in FIG. 2, have respective distal ends 51 and 53 and are each provided with strips of hook fastener material 54 and loop fastener material 56 disposed end to end along the outer sides of the straps, as shown. The straps 50 and 52 may be trained around the posterior casing 34, in its closed position, and through spaced apart grommets 58 supported on the anterior casing 32 generally opposite the point of attachment of the straps. The straps 50 and 52 may be trained through the grommets 58 and the respective hook fasteners portions 54 secured to their respective loop fastener portions 56 to secure the footwear 10 snugly on a wearer's foot in supportive relationship to the ankle and lower leg also.

Support and cushioning of a foot disposed in the footwear 10 is substantially enhanced by an inflatable brace suitably retained in the footwear 10, of unique construction and generally designated by the numeral 60 in FIGS. 1 and 2. The brace 60 is more clearly shown in FIG. 3 removed from the footwear 10 and displayed in a generally unfolded or planar position. The brace 60 includes a central inflatable bladder portion 62 having a shape generally conforming to the shape of the sole 12 and heel 14 of the footwear 10 and dimensioned to fit within the footwear supported on sole and heel member 18. The brace 60, including the bladder portion 62, may be characterized partly by a bottom pad 64 formed of a suitable, substantially fluid impervious flexible material. The brace 60 also includes opposed inflatable stay portions 66 and 68 extending on opposite sides from the central bladder portion 62 and also comprised of portions of the pad 64. A second set of opposed inflatable stays 67 and 69 extend from the central bladder portion 62 adjacent a rearward curved edge 63 of bladder portion 62 and portions of pad 64 also partially form these stays. The stays 66 and 67 are separated by an elongated somewhat V-shaped notch or recess 70 and the stays 68 and 69 are also separated by a similar notch or recess 71.

The recesses 70 and 71 may be deep enough to provide clearance for each prominence or malleolus of the ankle bones. The recesses or notches 70 and 71 also allow some fore and aft flexing of the brace 60 when the casings 32 and 34 are moved between open and closed positions to provide for ease of entry and exit of the foot with respect to the footwear 10. The stays 66 and 67 are joined at an inflatable base portion 72 and the stays 68 and 69 are joined at an inflatable base portion 74. Each of the stays, 66, 67, 68 and 69 and the bladder portion 62 are also formed by a layer of material having substantially the same outline as the pad 64 and forming a panel designated by the numeral 76. The material layer or panel 76 is also preferably formed of a fluid impervious flexible plastic material, for example, and is suitably thermally, chemically or adhesively bonded to the pad 64 about its peripheral edge to provide interior inflatable chambers for the central bladder portion 62 and the stays 66, 67, 68 and 69.

Figure 3:
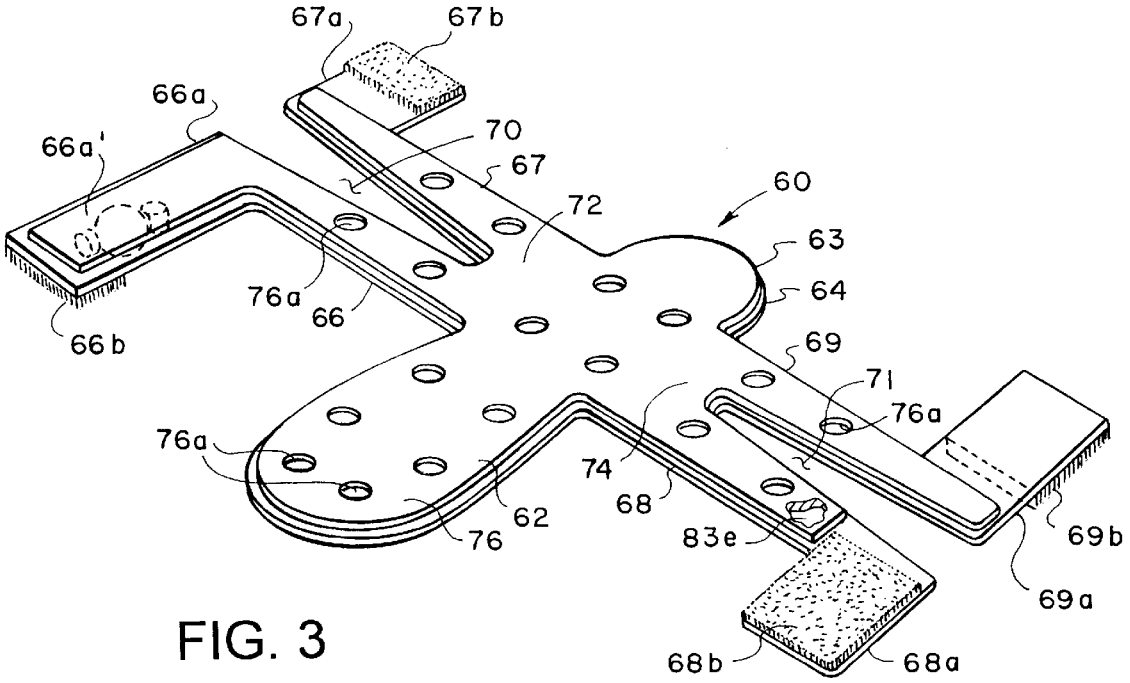
FIG. 3 is a perspective developed or plan view of an inflatable brace insert structure for the footwear shown in FIGS. 1 and 2.

The pad 64 and the panel 76 may also be spot welded or adhered to each other at spaced apart generally circular bosses 76*a*, several shown in FIG. 3, and arranged in a suitable pattern. The pad 64 is also configured to provide distal end portions, 66*a*, 67*a*, 68*a* and 69*a* of the respective stays 66, 67, 68 and 69 and which are adapted to support pads of fastener material, such as hook pads 68*b* and 69*b* which are cooperable with loop pads 67*b* and 66*b*. The distal end of stay 66 is provided with an inflatable laterally projecting portion, as indicated by the generally rectangular panel 66*a*', between the main body of the stay 66 and the loop faster pad 66*b*.

The inflatable brace 60 is operable to be permanently or temporarily secured in the footwear 10 to form a cushioning and support structure for a person's foot when disposed in the footwear. Referring to FIGS. 1, 2, and 4, the brace 60 may be disposed in the footwear 10 wherein the central bladder portion 62 is supported on a surface 77 of the inner sole and heel member 18. In fact, the brace 60 may be permanently secured in the footwear 10 by an adhesive layer 81 between the pad 64 and the surface 77.

Figure 5:
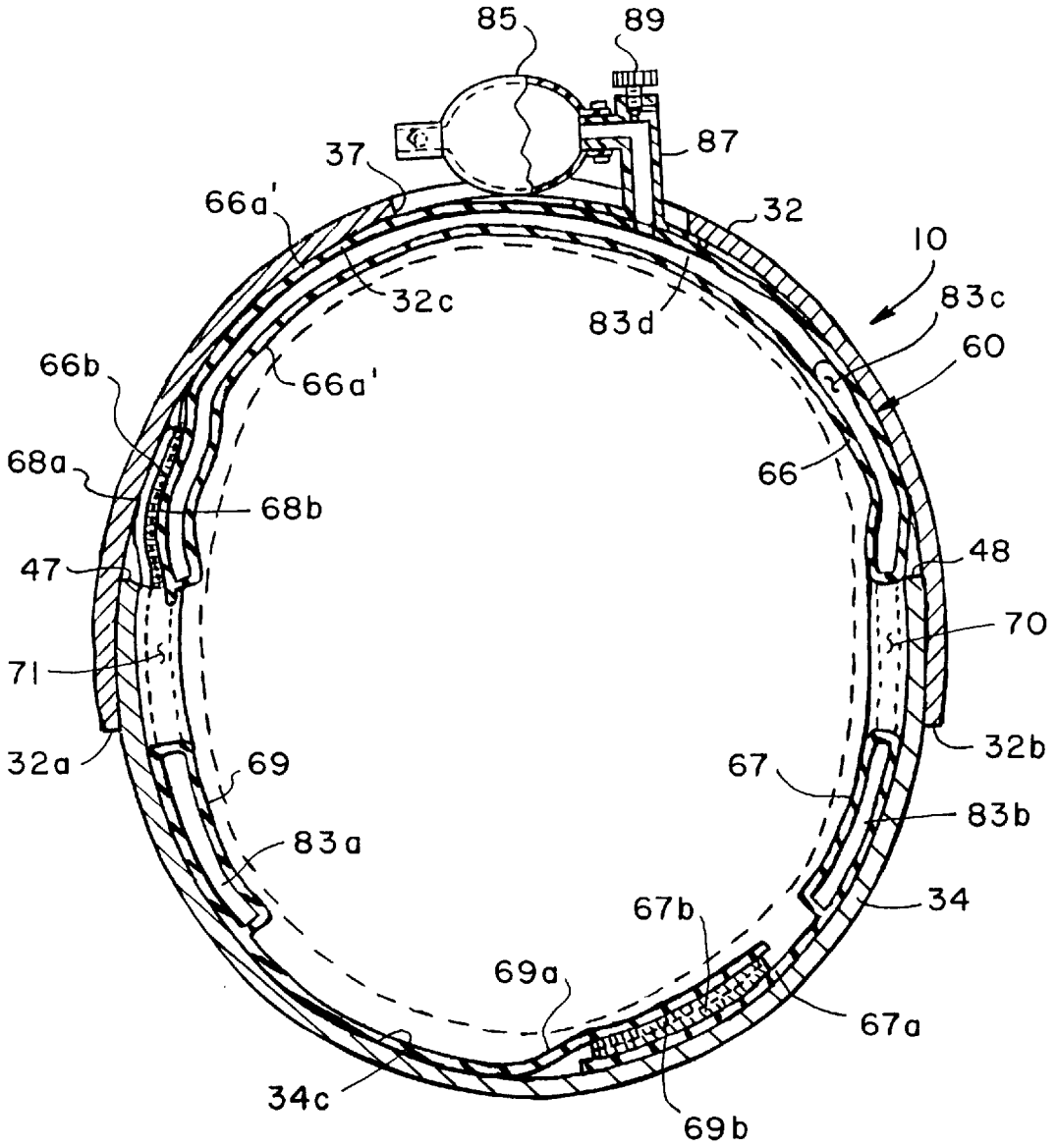
FIG. 5 is a section view taken generally along the line 5—5 of FIG. 1.

The stays 66 and 68 extend vertically upwardly within and are engaged with an interior concave surface 32*c* of the casing 32, see FIG. 5, with the fasteners 66*b* and 68*b* connected to each other so that the laterally projecting panel 66*a*' wraps around the front of the wearer's ankle and is disposed between the casing 32 and the adjacent area of such ankle or leg portion. FIG. 4 illustrates the main cushioning chamber 83 for the central bladder portion 62 of the brace. Chamber 83 is in fluid flow communication with chambers formed in each of the stays 66, 66*a*', 67, 68 and 69 and brace portions 72 and 74. For example, referring to FIG. 5, a chamber 83*a* is formed in stay 69, a chamber 83*b* is formed in stay 67, and a chamber 83*c* is formed in stay 66 and includes a branch portion 83*d* extending across the lower leg and overlapping the distal end 68*a* of the stay 68. A chamber 83*e* is formed in that portion of stay 68 which is adjacent to the chamber 83*d* when the brace 60 is secured in the position shown in FIG. 5. Typically, the stays 67 and 69 are secured to each other by the fasteners 67*b* and 69*b* while the stay 66, particularly the laterally projecting portion 66*a*', is secured to the stay 68 also by the adjustable fasteners 66*b* and 68*b*.

The chambers 83 and 83*a* through 83*e* are operable to the inflated with pressure fluid, such as air, by a small flexible bulb type pump 85, see FIGS. 1, 2 and 5. The pump 85 includes a suitable fitting 87 suitably secured to the portion of the pad 64 which comprises the laterally projecting portion 66*a*' of the stay 66. The fitting 87 is suitably connected to the bulb pump 85 and also supports a suitable manually operated vent or pressure regulator valve 89 for venting pressure air from the chambers 83 and branch portions 83*a* through 83*e*. The pump 85 and fitting 87 are preferably disposed in opening 37 in casing 32.

Accordingly, a person donning the footwear 10 may first adjust the positions of stays 66, 66*a*', 67, 68 and 69 by the fastener pads 66*b*, 68*b*, 67*b* and 69*b*. Then the casings 32 and 34 are closed and after the casings 32 and 34 have been brought to a closed position and latched by the straps 50 and 52 in the position shown in FIG. 1, the brace 60 may be inflated by the pump 85 to provide suitable support to the entire bottom of the foot as well as both sides of the ankle and lower leg surrounded by the casings 32 and 34. The brace stays 66, 66*a*', 67, 68, and 69 tend to hold the ankle and leg also in a slight standoff position from the casings 32 and 34, although these casings, being of flexible material, may engage the leg, ankle and foot at any one point without detriment to the wearer of the footwear 10. The stays 67 and 69 may also, if desired, be suitably bonded to the inner wall surface 34*c* of the casing 34 and the stays 66 and 68 may be bonded to the interior wall 32*c* of anterior casing 32.

However, if the central bladder portion 62 of the brace 60 is secured within the footwear 10 as described above the generally vertically extending stays 66, 67, 68 and 69 may be left unsecured to the anterior and posterior casing members 32 and 34 so that the positions of the stays relative to each other may be adjusted by their respective fastener strips whereby the working positions of the stays are in a desired location for the wearer.

Thanks to the deep notches or recesses 70 and 71, the stays 66 and 67 and the stays 68 and 69, respectively, extend along the medial and lateral portions of the ankle and lower leg without covering the prominences of the ankle bones and possibly causing discomfort to the wearer of the footwear 10 when the casing 32 and 34 are secured in the closed working position of FIG. 1. Although, in FIG. 5, the forward edges 47 and 48 of the posterior casing 34 are shown in overlapping relationship with respect to the portion 66*a*' of the stay 66, the length of the portion 66*a*' may be reduced and offset such that the edges 47 and 48 are not contiguous therewith.

By providing the inflatable brace 60 comprising the central bladder portion 62 on which the wearer's foot rests when disposed in the footwear 10, together with the generally vertical extending stays 66, 66*a*', 67, 68 and 69 for supporting the ankle and lower leg, a substantially enhanced support structure is provided for the wearer's foot, ankle and lower leg by the footwear 10. Moreover, since the central bladder portion 62 of the brace 60 is disposed below the foot, the brace not only supports and securely places the foot in engagement with the forward casing or toe cap 16 as well as the casings 32 and 34, but also provides a cushioning structure for absorbing impact and shock forces transmitted during running, stressful athletic endeavors or any event which might ordinarily transmit a painful or bruising force through the footwear to the wearer's foot.

The construction and use of the footwear 10 is believed to be within the purview of one of ordinary skill in the art from the foregoing description. Moreover, the materials used for the various components described above which are not specifically identified may also be selected by the art worker based on the foregoing description and description in the above referenced co-pending application as well as in my earlier U.S. Pat. No. 5,451,201.

Although a preferred embodiment of an improved footwear with inflatable brace has been described in detail herein, those skilled in the art will further recognize that various substitutions and modifications may be made without departing from the scope and spirit of the invention as recited in the appended claims.

What is claimed is:

1. Footwear for supporting the ankle and foot of a wearer, comprising:

a sole member including a posterior heel part;

a lower casing formed of a generally flexible material secured to and above said sole member;

a generally flexible vertically extending anterior casing member connected to said lower casing for movement relative thereto;

a generally vertically extending posterior casing member connected to said lower casing for movement relative thereto;

fastening means for securing said casing members to each other and to a wearer's ankle; and inflatable brace means including portions disposed between said casing members and said wearer's ankle to enhance the support of said wearer's ankle and foot with respect to said footwear, said brace means including a plurality of generally vertically extending stays interposed said casing members, said stays defining inflatable chambers operable to be pressurized with pressure fluid to aid in supporting the ankle of a wearer of said footwear, said stays being arranged in opposed pairs, each stay of a pair of stays including a distal end portion and being separated from the other stay of said pair of stays by a notch which provides clearance for a prominence of an ankle bone of the wearer of said footwear to be disposed between the stays of a pair of stays, respectively.

2. The footwear set forth in claim 1 wherein:

said footwear includes pivot means jointly fastening said casing members to said lower casing at opposite sides thereof, respectively for pivotal movement between a working position and an open position to provide for entry or exit of a foot with respect to said footwear.

3. The footwear set forth in claim 1 wherein:

said casing members are formed of a flexible material and said fastening means is connected to one of said casing members and is operable to engage the other of said casing members to secure said footwear to a wearer's foot.

4. The footwear set forth in claim 3 wherein:

said fastening means comprises at least one strap connected to one of said casing members and of sufficient length to extend around the other of said casing members and engageable with at least one grommet supported on said one casing member and adapted to receive said strap.

5. The footwear set forth in claim 4 including:

means on a distal end of said strap operable to provide for securing said strap to itself.

6. The footwear set forth in claim 1 wherein:

said brace means includes a central bladder portion supported on said sole member and adapted to support a foot of a wearer of said footwear, said bladder portion including inflatable chamber means for inflating said brace means to provide a cushioning structure for a wearer of said footwear.

7. The footwear set forth in claim 1 wherein:

at least one of said stays includes a lateral branch portion adapted to extend across the front of the lower leg of a wearer of said footwear.

8. The footwear set forth in claim 1 wherein:

each pair of stays is connected to a central bladder portion of said brace means by opposed base portions of said brace means, said stays, said base portions and said central bladder portion comprising interconnected inflation chambers for inflating said brace means to provide a cushioning structure for the bottom of a wearer's foot and for opposite sides of the ankle and lower leg.

9. The footwear set forth in claim 1 including:

manually actuatable pump means connected to said brace means and supported on said footwear for inflating said brace means with pressure fluid.

10. The footwear set forth in claim 9 including:

pressure regulator means operably connected to said brace means for regulating the pressure of said pressure fluid therein.

11. The footwear set forth in claim 10 wherein:

said pump means is disposed on one of said casing members.

12. The footwear set forth in claim 11 wherein:

said pump means is supported on said anterior casing member.

13. The footwear set forth in claim 1 wherein:

said casing members comprise generally frustoconical shaped members rising from said sole member and movable between open and closed positions.

14. The footwear set forth in claim 13 wherein:

said sole member includes a curb engageable with said casing members to limit movement of said casing members between a closed working position and an open position to permit entry or exit of a foot with respect to said footwear.

15. A pivot entry shoe comprising:

a flexible base member including a forward sole portion and a rearward heel portion for providing flexibility of movement of a wearer's foot;

a flexible forward casing attached to and above said forward portion of said flexible base member;

a pair of flexible, complementary, generally frustoconical casing members extending upward from said base member for providing support to a wearer's ankle and lower leg;

means for pivotally securing said pair of frustoconical casing members to said base member;

inflatable brace means including a central bladder portion supported on said sole portion and spaced apart, generally vertically extending stays connected to said central bladder portion and extending upward along and on both sides of a wearer's ankle and lower leg and imposed between said wearer's ankle and lower leg and said generally frustoconical casing members, said stays being arranged in opposed pairs, each stay of a pair of stays including a distal end portion and being separated from the other stay of said pair of stays by a notch which provides clearance for a prominence of an ankle bone of the wearer of said footwear to be disposed between the stays of a pair of stays, respectively; and means for securing said frustoconical casing members to said wearer's ankle and lower leg with said stays disposed therebetween.

16. The pivot entry shoe set forth in claim 15 wherein:

said frustoconical casing members overlap at opposed longitudinal side edges thereof, respectively.

17. The pivot entry shoe set forth in claim 15 wherein:

said brace means includes manually actuatable pump means connected thereto and supported on said pivot entry shoe for inflating inflatable chambers of said brace means with pressure air.

18. The footwear set forth in claim 17 including:

pressure regulator means operably connected to said brace means for regulating the pressure of said pressure air in said chambers.

19. The footwear set forth in claim 17 wherein: said pump means is supported on one of said frustoconical casing members.

20. Footwear for supporting the ankle and foot of a wearer, comprising:

a sole member including a posterior heel part;

a lower casing formed of a generally flexible material secured to and above said sole member;

a generally flexible vertically extending anterior casing member connected to said lower casing for movement relative thereto, said anterior casing member including a lower peripheral edge and a rigid reinforcing member disposed on said anterior casing member adjacent said edge;

a generally flexible vertically extending posterior casing member connected to said lower casing for movement relative thereto;

fastening means for securing said casing members to each other and to a wearer's ankle; and inflatable brace means including portions disposed between said casing members and said wearer's ankle to enhance the support of said wearer's ankle and foot with respect to said footwear, said brace means including a plurality of generally vertically extending stays interposed said casing members, said stays defining inflatable chambers operable to be pressurized with pressure fluid to aid in supporting the ankle of a wearer of said footwear, said stays being arranged in opposed pairs, each stay of a pair of stays including a distal end portion and being separated form the other stay of said pair of stays by a notch which provides clearance for a prominence of an ankle bone of the wearer of said footwear to be disposed between the stays of a pair of stays, respectively.

21. Footwear for supporting the ankle and foot of a wearer, comprising:

a sole member including a posterior heel part;

a lower casing formed of a generally flexible material secured to and above said sole member;

a generally flexible vertically extending anterior casing member connected to said lower casing for movement relative thereto;

a generally vertically extending posterior casing member connected to said lower casing for movement relative thereto, said posterior casing member including a lower peripheral edge and a rigid reinforcing member disposed on said posterior casing member adjacent said edge;

fastening means for securing said casing members to each other and to a wearer's ankle; and inflatable brace means including portions disposed between said casing members and said wearer's ankle to enhance the support of said wearer's ankle and foot with respect to said footwear, said brace means including a plurality of generally vertically extending stays interposed said casing members, said stays defining inflatable chambers operable to be pressurized with pressure fluid to aid in supporting the ankle of a wearer of said footwear, said stays being arranged in opposed pairs, each stay of a pair of stays including a distal and portion and being separated from the other stay of said pair of stays by a notch which provides clearance for a prominence of an ankle bone of the wearer of said footwear to be disposed between the stays of a pair of stays, respectively.

* * * * *